US011758994B2

(12) United States Patent
Streng et al.

(10) Patent No.: US 11,758,994 B2
(45) Date of Patent: Sep. 19, 2023

(54) SOFT-SIDED STORAGE CONTAINER WITH EXOSKELETON FRAME

(71) Applicant: Big Time Products, LLC, Rome, GA (US)

(72) Inventors: Jarrod Thomas Streng, Atlanta, GA (US); Christopher Weed, Atlanta, GA (US); Mark Butts, Atlanta, GA (US); Ryan Kubica, Atlanta, GA (US); James Blake Fievet, Atlanta, GA (US); Jing Li, Atlanta, GA (US)

(73) Assignee: BIG TIME PRODUCTS, LLC, Rome, GA (US)

( * ) Notice: Subject to any disclaimer, the term of this patent is extended or adjusted under 35 U.S.C. 154(b) by 758 days.

(21) Appl. No.: 16/723,172

(22) Filed: Dec. 20, 2019

(65) Prior Publication Data

US 2020/0205532 A1 Jul. 2, 2020

Related U.S. Application Data

(60) Provisional application No. 62/785,555, filed on Dec. 27, 2018.

(51) Int. Cl.
*A45C 5/14* (2006.01)
*A45C 13/26* (2006.01)
(Continued)

(52) U.S. Cl.
CPC ..... *A45C 5/14* (2013.01); *A45C 13/04* (2013.01); *A45C 13/103* (2013.01);
(Continued)

(58) Field of Classification Search
CPC ..... A45C 5/14; A45C 13/04; A45C 13/103; A45C 13/262; A45C 13/30;
(Continued)

(56) References Cited

U.S. PATENT DOCUMENTS 3,117,692 A * 1/1964 Carpenter ..... B65D 43/0212 206/508
3,376,046 A * 4/1968 Jeromes ..... B62B 1/10 206/508

(Continued)

OTHER PUBLICATIONS

J. Husky (https://www.youtube.com/watch?v=y7po-aGcpxY) (Year: 2021).*

(Continued)

*Primary Examiner* — Jennifer Robertson
*Assistant Examiner* — Justin Caudill
(74) *Attorney, Agent, or Firm* — THOMPSON HINE LLP

(57) ABSTRACT

A storage container includes a rigid bottom, a first side wall, a second side wall, a third side wall, a fourth side wall and a top, wherein the first, second, third and fourth side walls each comprise primarily fabric. The top defines an opening to an interior of the storage container. A rigid exterior frame includes a first side wall frame portion connected to the first side wall, a second side wall frame portion connected to the second side wall, a first top frame portion, and a second top frame portion, the first top frame portion interconnecting the first side wall frame portion and the second side wall frame portion, the second top frame portion interconnecting the first side wall frame portion and the second side wall frame portion.

17 Claims, 20 Drawing Sheets

(51) Int. Cl.

| | |
|---|---|
| ***A45C 13/10*** | (2006.01) |
| ***B65D 21/02*** | (2006.01) |
| ***A45C 13/04*** | (2006.01) |
| ***A45C 13/30*** | (2006.01) |
| ***B25H 3/02*** | (2006.01) |

(52) U.S. Cl.
CPC ..... *A45C 13/262* (2013.01); *A45C 13/30* (2013.01); *B65D 21/0213* (2013.01); *A45C 2013/267* (2013.01); *A45C 2013/306* (2013.01); *B25H 3/02* (2013.01)

(58) Field of Classification Search
CPC ..... A45C 2013/267; A45C 2013/306; A45C 7/0086; A45C 2003/008; B65D 21/0213; B65D 37/00; B25H 3/02
See application file for complete search history.

(56) References Cited

U.S. PATENT DOCUMENTS

| | | | | |
|---|---|---|---|---|
| 5,167,336 | A * | 12/1992 | Lajovic | B65D 21/0212 52/DIG. 9 |
| 7,267,229 | B2 | 9/2007 | Chen | |
| 8,151,938 | B2 | 4/2012 | Kinskey | |
| 8,256,635 | B2 | 9/2012 | Schardein | |
| 8,430,262 | B2 | 4/2013 | Corbett | |
| 8,490,796 | B2 * | 7/2013 | Saito | H01L 21/67353 190/18 A |
| 9,132,543 | B2 * | 9/2015 | Bar-Erez | B62B 1/04 |
| 9,452,857 | B2 | 9/2016 | Corbett | |
| 9,469,470 | B2 * | 10/2016 | Stahl | B65D 21/0212 |
| 9,629,444 | B2 | 4/2017 | Isensee | |
| 9,725,209 | B1 * | 8/2017 | Ben-Gigi | B25H 3/021 |
| 10,005,605 | B2 | 6/2018 | Corbett | |
| 10,029,597 | B2 | 7/2018 | Reynolds | |
| 10,080,420 | B2 | 9/2018 | Alexis | |
| 10,165,847 | B2 | 1/2019 | Chapman | |
| 2006/0254946 | A1 * | 11/2006 | Becklin | B65D 21/0223 206/508 |
| 2010/0219193 | A1 * | 9/2010 | Becklin | B65D 21/0224 220/630 |
| 2010/0290877 | A1 * | 11/2010 | Landau | B25H 3/027 414/490 |
| 2011/0075953 | A1 * | 3/2011 | Cook, Jr. | B65D 31/06 383/105 |
| 2011/0139777 | A1 * | 6/2011 | Kivett | B65D 45/22 220/23.83 |
| 2012/0006837 | A1 * | 1/2012 | Becklin | B65D 21/023 220/694 |
| 2012/0074022 | A1 * | 3/2012 | McTavish | B65D 21/045 206/503 |
| 2014/0311844 | A1 * | 10/2014 | Meersschaert | A45C 13/02 190/122 |
| 2016/0144500 | A1 * | 5/2016 | Chen | B65D 21/023 206/349 |
| 2017/0166352 | A1 * | 6/2017 | Hoppe | B25H 3/022 |
| 2017/0182652 | A1 * | 6/2017 | Martinez | A45C 3/001 |
| 2017/0341810 | A1 * | 11/2017 | Banik | B65D 19/18 |
| 2018/0044059 | A1 * | 2/2018 | Brunner | B25H 3/02 |
| 2018/0161975 | A1 * | 6/2018 | Brunner | B65D 21/0223 |
| 2018/0273245 | A1 * | 9/2018 | Sommer | B65D 21/0212 |

OTHER PUBLICATIONS

Milwaukee Tool: https://www.youtube.com/watch?v=9hyY_ICeN0M (Year: 2017).*

* cited by examiner

SOFT-SIDED STORAGE CONTAINER WITH EXOSKELETON FRAME

CROSS-REFERENCE

This application claims the benefit of U.S. provisional application Ser. No. 62/785,555, filed Dec. 27, 2018, the entirety of which is hereby incorporated by reference.

TECHNICAL FIELD

This application relates generally to storage containers and, more specifically, to a soft-sided storage container with an exoskeleton frame.

BACKGROUND

Storage containers can be used for a variety of purposes. At construction sites, storage containers are often used to store tools and other equipment. Existing storage containers used at construction sites have two varieties—hard-sided and soft-sided. Hard-sided storage containers have rigid walls made of hard plastic, metal, or a combination thereof. Hard-sided storage containers are typically durable, waterproof, and stackable. However, hard-sided storage containers can be heavy and difficult to transport, rigid with minimal capability for expansion or reorganization, and cumbersome if not properly closed or latched. On the other hand, soft-sided storage containers can be easier to transport given their relatively lighter weight and no need to latch or close, have more flexibility due to their soft sides, and have greater flexibility for pockets and other organizing features. However, soft-sided storage containers have limitations in that they may not be waterproof, their fabric material is more susceptible to wear and tear, and they are not conducive to stacking.

In light of the foregoing limitations with existing storage containers, an improved storage container and storage system would be desirable.

SUMMARY

In one aspect, a storage container includes a bottom, a first side wall, a second side wall, a third side wall, a fourth side wall and a top, wherein the first, second, third and fourth side walls each comprise primarily fabric, wherein the bottom is a rigid bottom, wherein the top defines an opening to an interior of the storage container. A rigid exterior frame, the rigid exterior frame comprising a first side wall frame portion connected to the first side wall, a second side wall frame portion connected to the second side wall, a first top frame portion, and a second top frame portion, the first top frame portion interconnecting the first side wall frame portion and the second side wall frame portion, the second top frame portion interconnecting the first side wall frame portion and the second side wall frame portion. The first top frame portion and the second top frame portion are spaced apart to enable access to the interior through the opening.

In another aspect, a storage container includes a bottom, a first side wall, a second side wall, a third side wall, a fourth side wall and a top, wherein the first, second, third and fourth side walls each comprise primarily fabric, wherein the bottom is a rigid bottom, wherein the top defines an opening to an interior of the storage container. A rigid frame supports the first, second, third and fourth side walls, the rigid frame including an exterior frame portion located externally of the interior and an interior frame portion located within the interior. The interior frame portion is connected to the interior frame portion by a plurality of fasteners passing through one or more of the first, second, third and fourth side walls.

In a further aspect, a storage system with variable stackability includes a first storage container, a second storage container and a third storage container. The first storage container including a rigid bottom with a pair of first stacking recesses and a pair of second stacking recesses, the first storage container including a top with a pair of first stacking projections. The second storage container including a rigid bottom with a pair of third stacking recesses and a pair of fourth stacking recesses, the second storage container including a top with a pair of second stacking projections. The third storage container including a top with a pair of third stacking projections. A spacing between the pair of first stacking recesses is a first distance. A spacing between the pair of second stacking recesses is a second distance, the second distance larger than the first distance. A spacing between the pair of first stacking projections is the first distance. A spacing between the pair of third stacking recesses the first distance. A spacing between the pair of fourth stacking recesses is the second distance. A spacing between the pair of second stacking projections is the second distance. A spacing between the pair of third stacking projections is the second distance. The first storage container is stackable atop the second storage container by engaging the second stacking recesses of the first storage container with the second stacking projections of the second storage container. The first storage container is stackable atop the third storage container by engaging the second stacking recesses of the first storage container with the third stacking projections of the third storage container. The second storage container is stackable atop the first storage container by engaging the third stacking recesses of the second storage container with the first stacking projections of the first storage container. The second storage container is stackable atop the third storage container by engaging the fourth stacking recesses of the second storage container with the third stacking projections of the third storage container.

The details of one or more embodiments are set forth in the accompanying drawings and the description below. Other features, objects, and advantages will be apparent from the description and drawings, and from the claims.

DETAILED DESCRIPTION

Figure 1:
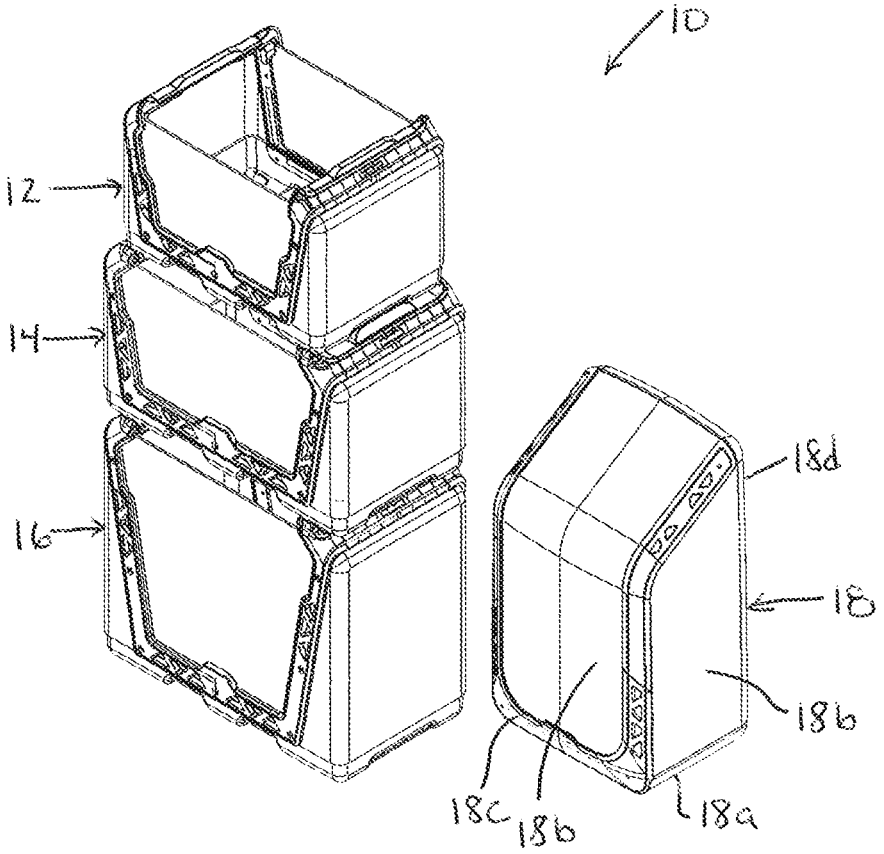
FIG. 1 is a perspective view of a storage system with multiple containers.
Figure 2:
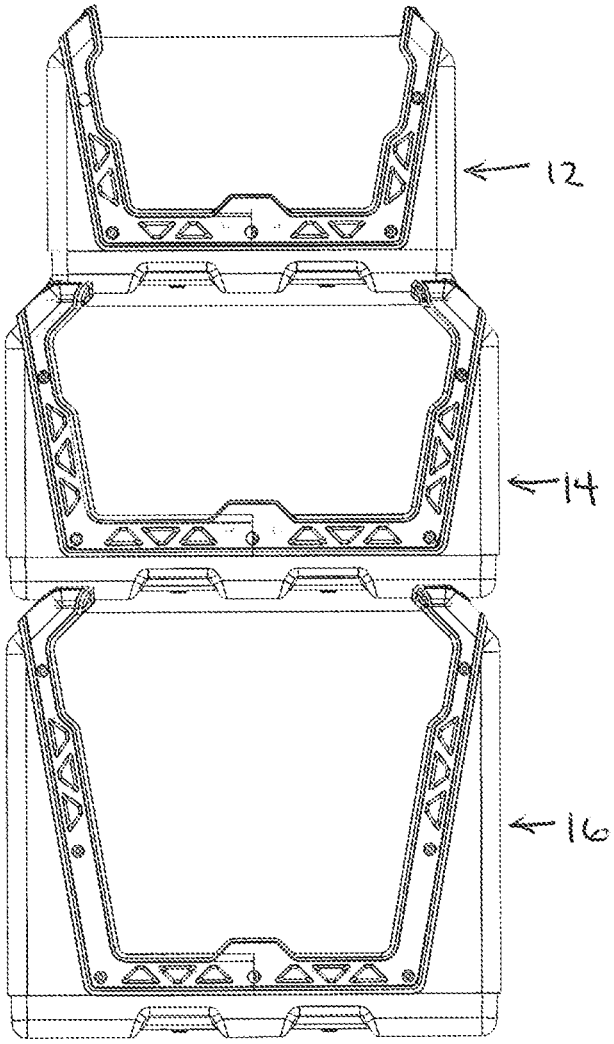
FIG. 2 is a front elevation view of part of the stacked containers of the storage system.
Figure 3:
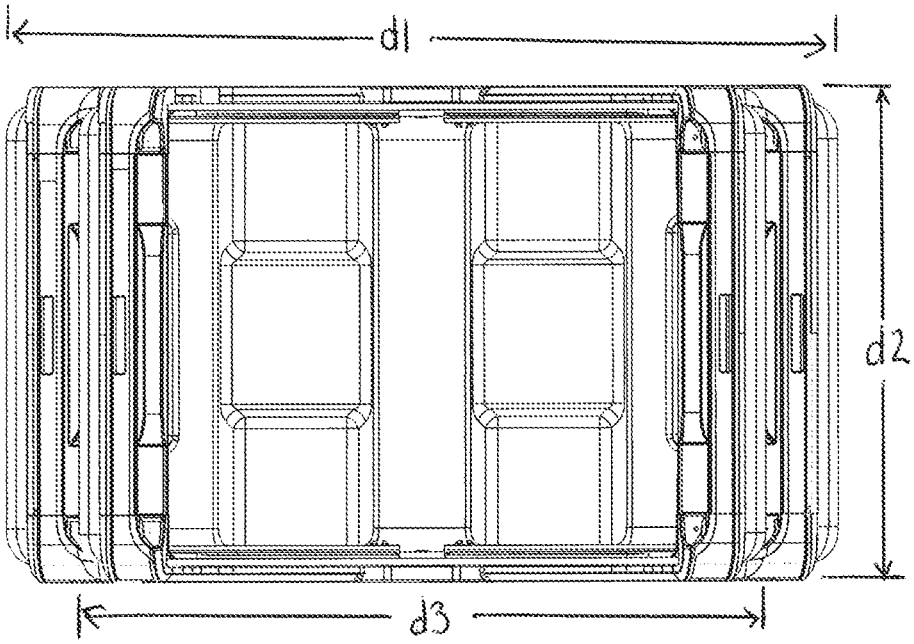
FIG. 3 is a top plan view of FIG. 2.
Figure 4:
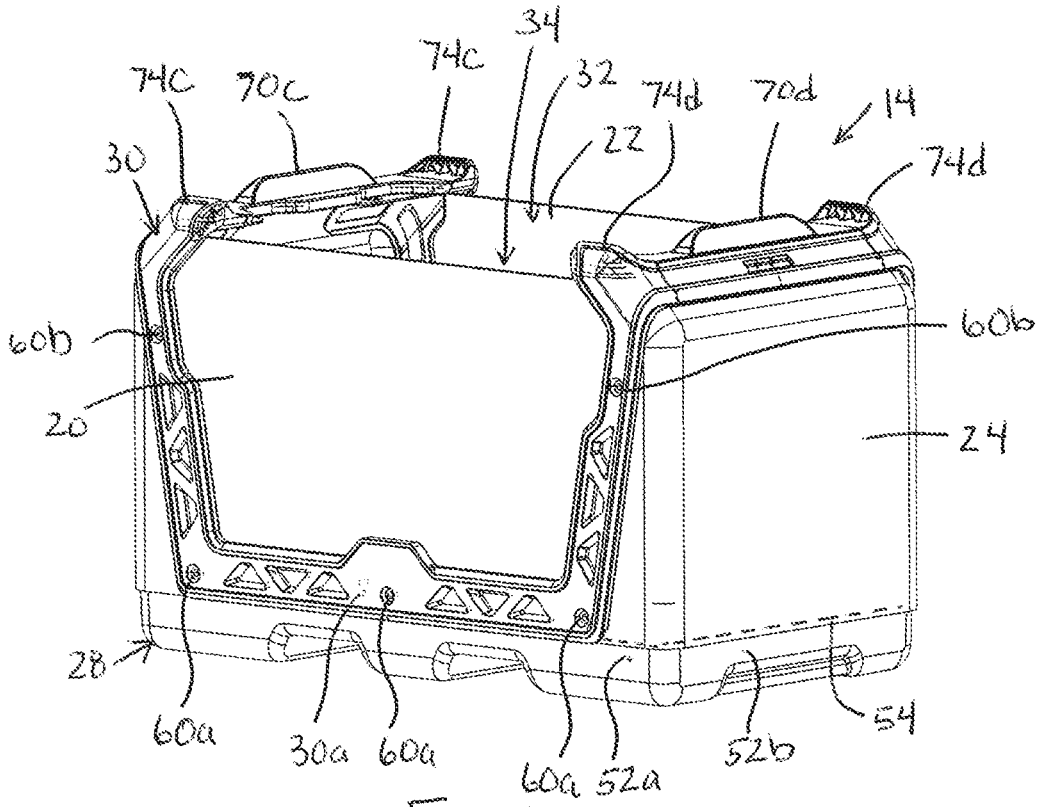
FIG. 4-12 depict various features of one of the containers of the storage system.
Figure 5:
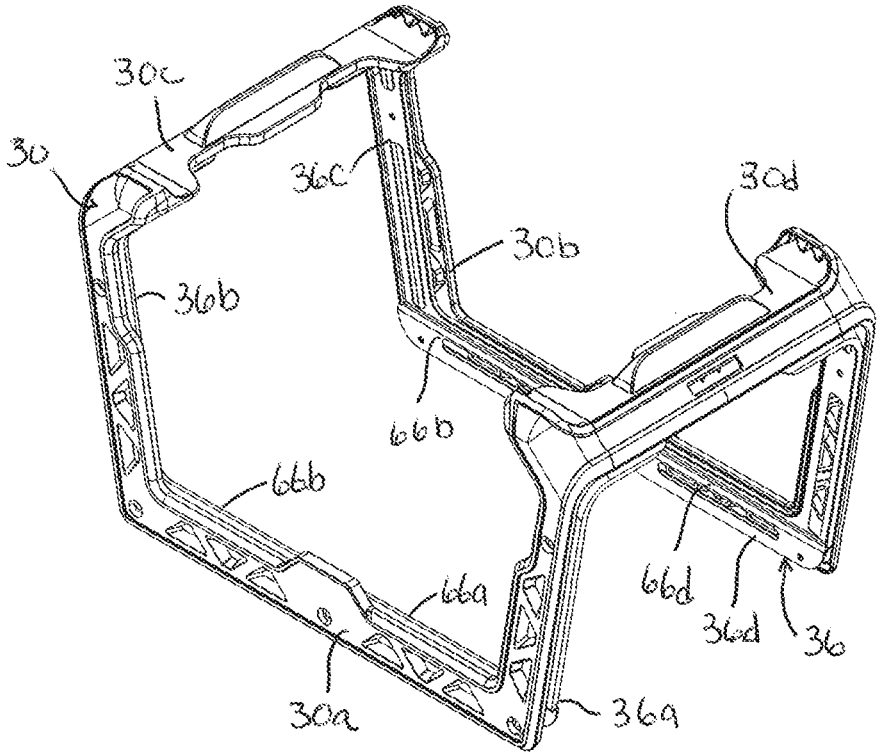
Figure 6:
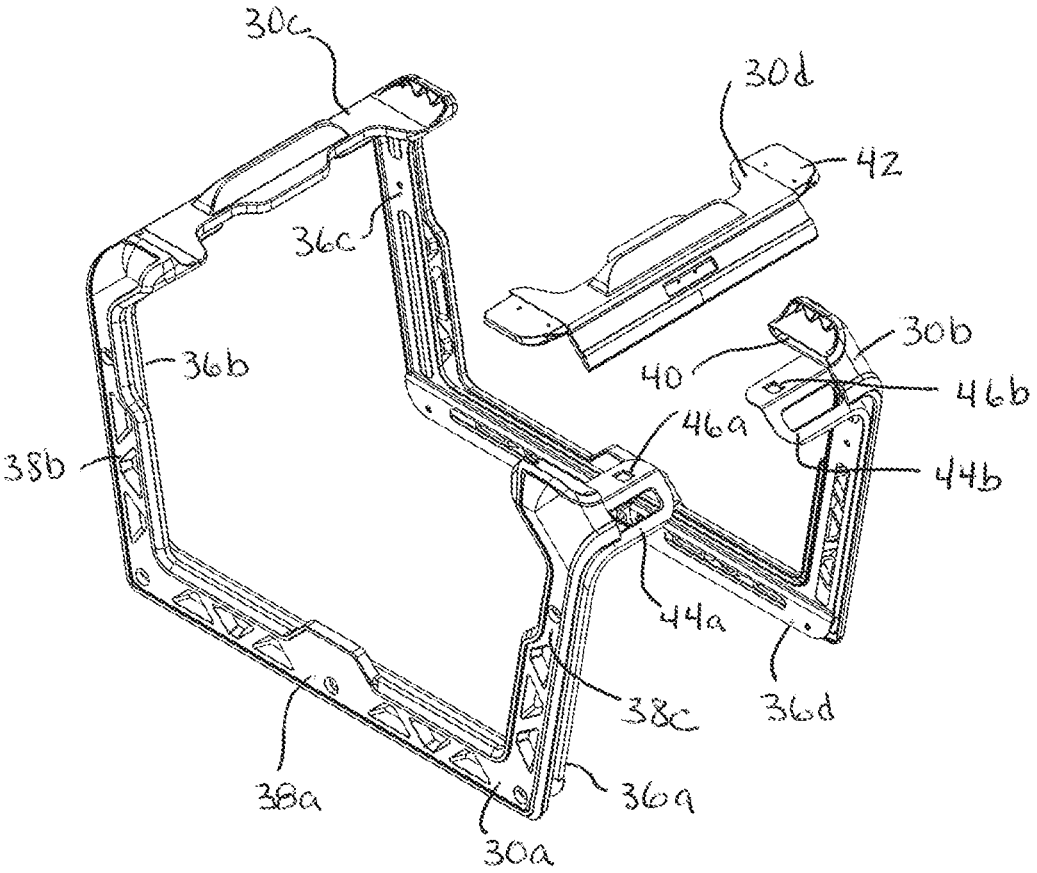
Figure 7:
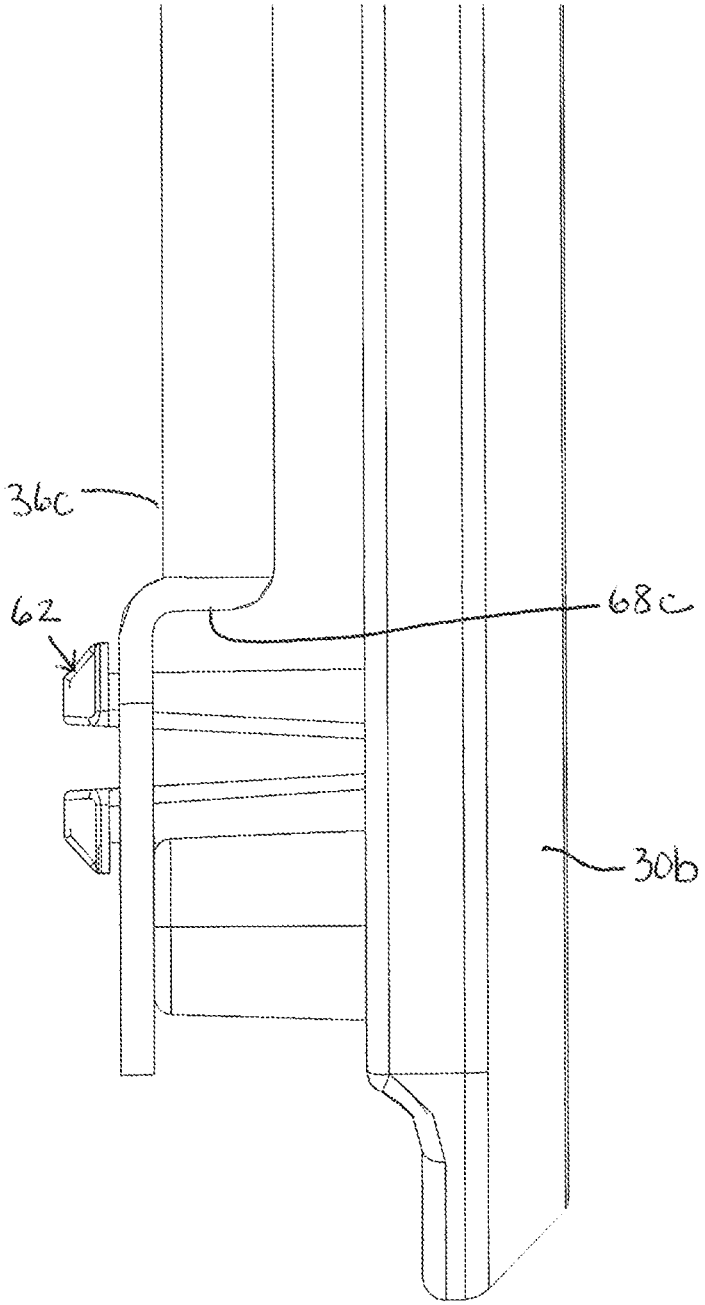
Figure 8:
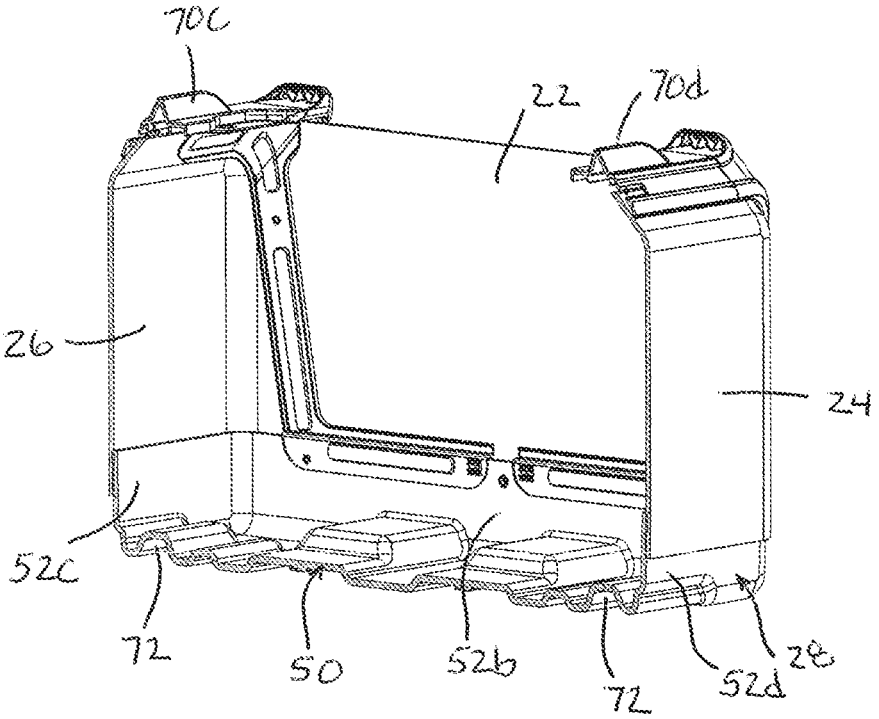
Figure 9:
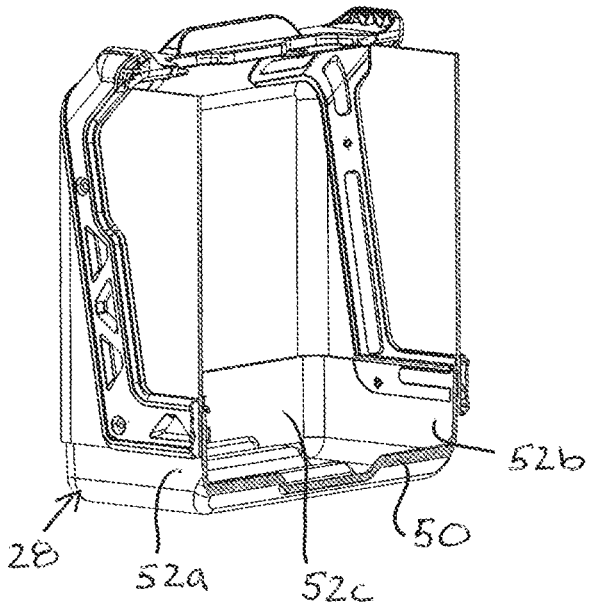
Figure 10:
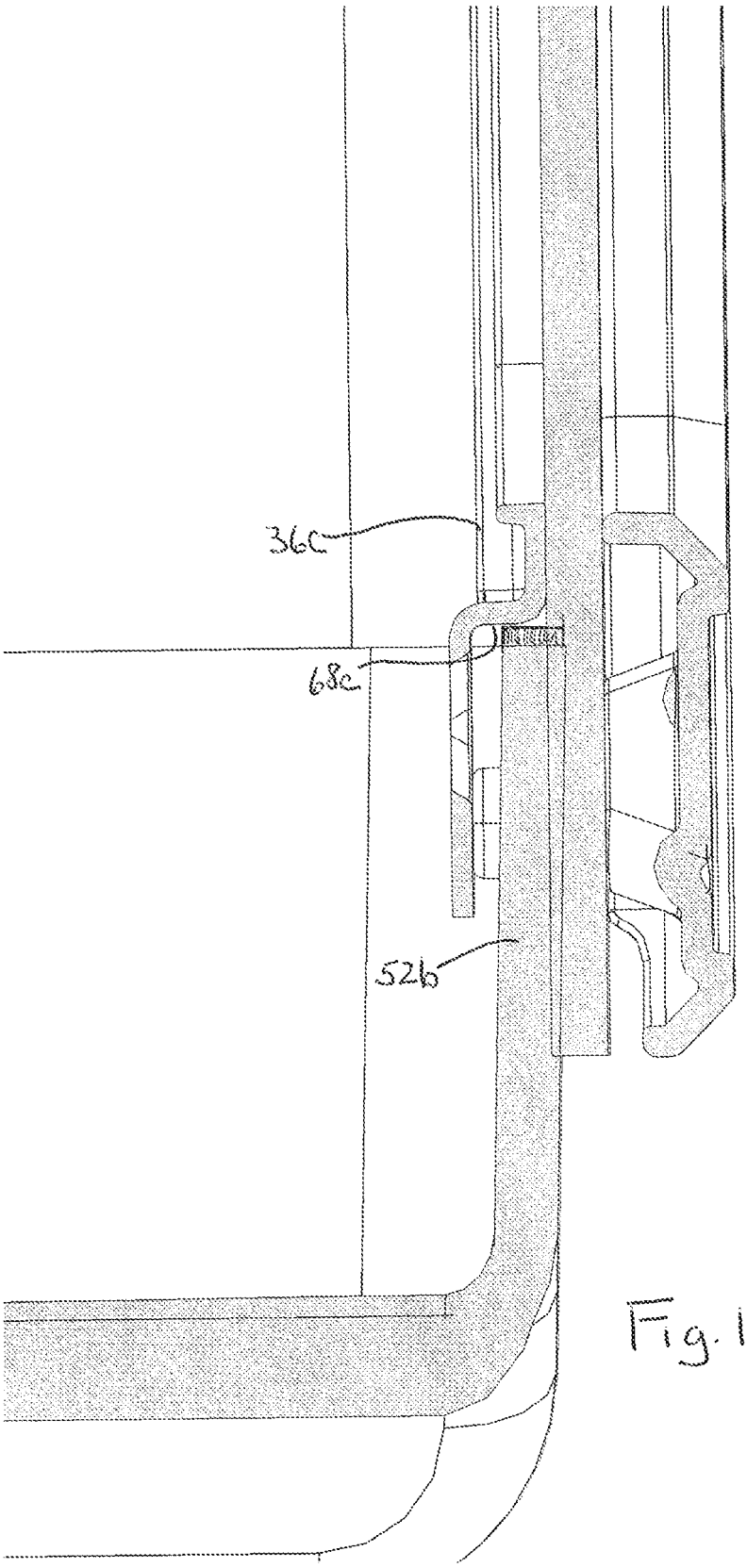
Figure 11:
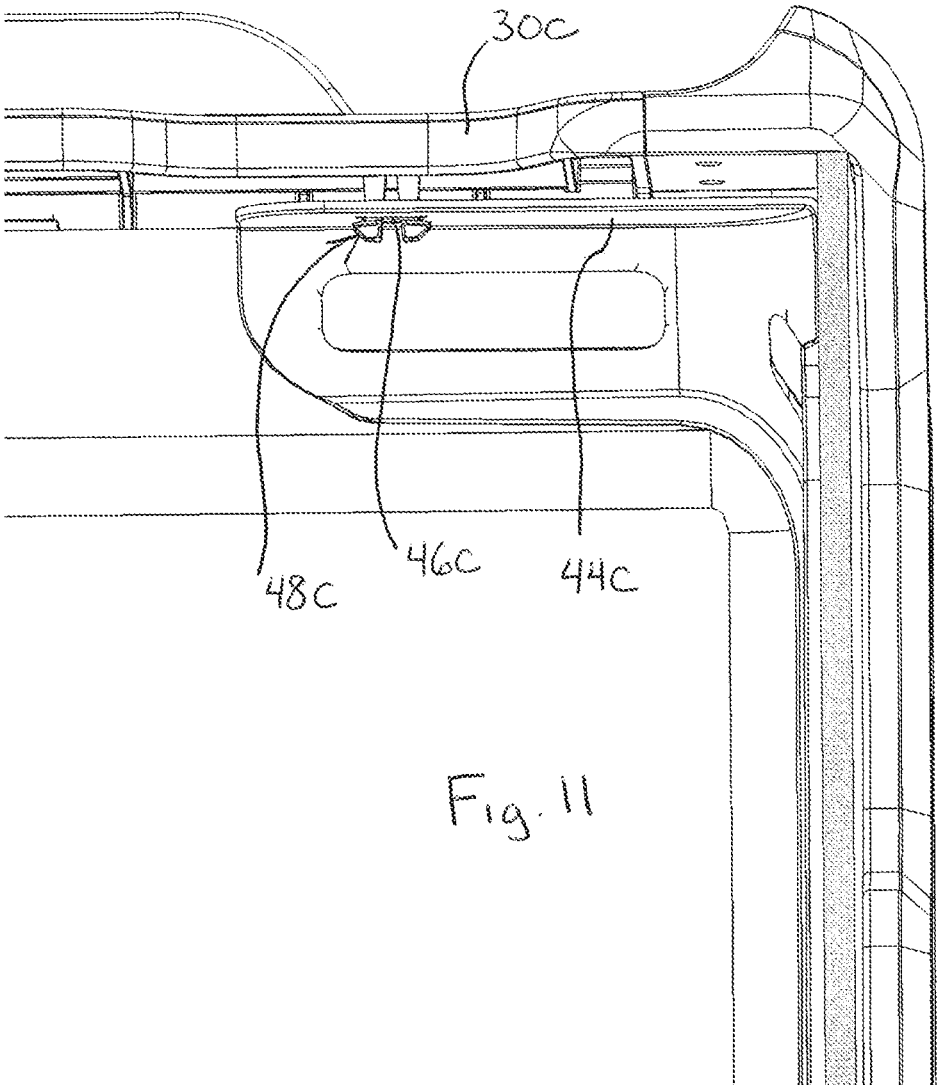
Figure 12:
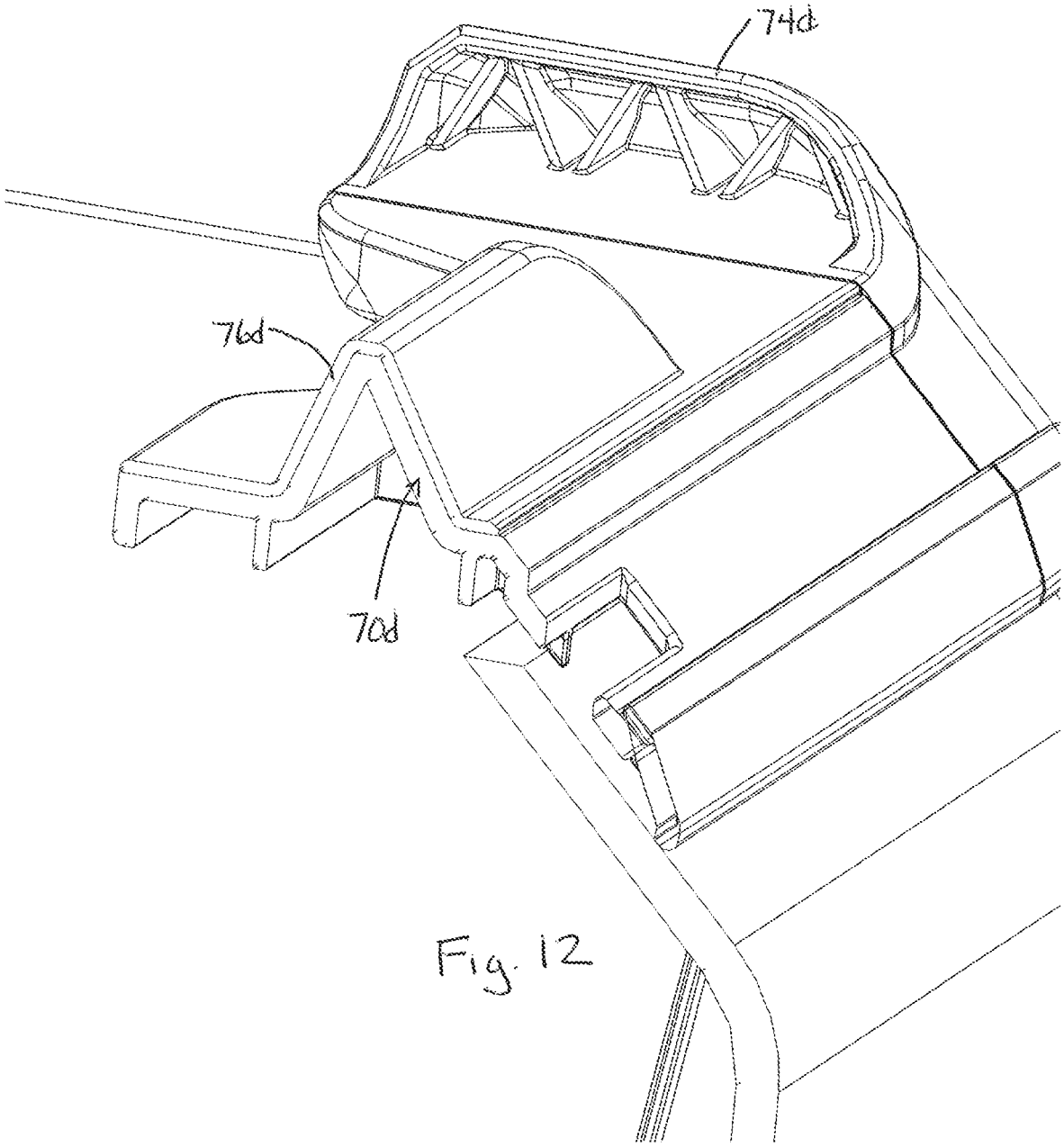

Referring to FIG. 1, a storage system 10 includes multiple containers. Here, three box-style/shape containers 12, 14 and 16 are shown, along with a back-pack style/shape container 18. The containers are stackable and, as will be explained in more detail below, the stackability of the containers is variable and versatile. Notably, as seen in FIGS. 2 and 3, the containers 12, 14 and 16 are of different sizes, with container 16 being larger (in internal volume) than container 14, and container 14 being large than container 12. The footprint size, in top plan view, of containers 14 and 16 is, in the illustrated embodiment, substantially the same (generally d1×d2). However, the footprint size, in top plan view, of container 12 is smaller (generally d3×d2).

Referring to FIGS. 4-12, images of the container 14 are shown, by way of example, reflect the overall configuration used for the collective set of containers. The container 14 is made of a combination of soft, but strong fabric on the side panels or walls 20, 22, 24 and 26, a rigid bottom 28 and a rigid exterior frame 30 (referred to as the exoskeleton). By way of example, the fabric may be materials such as polyester, nylon, cotton, polyvinyl chloride (PVC), polyethelene, polyurethane, other flexible material or any combination of the foregoing, and the rigid bottom and exterior frame may be formed of materials such as acrylonitrile butadiene styrene (ABS), polypropylene (PP), polyethelyne (PE), ethylene-vinyl acetate (EVA), thermoplastic rubber (TPR), or fiber-reinforced resins or polymers. The container 14 also includes a top that defines and access opening 32 to the interior 34 of the container.

The rigid exterior frame 30 may be fixed to the exterior surface of the fabric panels of the container at one or more points along the frame using any of a variety of attachment methods, including fasteners, adhesives, stitching, or other attachment methods known to those in this field. In the illustrated embodiment, the exterior frame 30 forms part of a frame system that also includes an interior frame portion 36. Here, the interior frame portion 36 is made up of four separate frame components 36*a*-36*d*, and the exterior frame 30 is made up for four separate frame components 30*a*-30*d* that are connected to each other. However, the number of components utilized to make up each of the interior frame portion and the exterior frame could vary.

As to the illustrated exterior frame 30, each frame component 30*a* and 30*b* makes up a respective side wall frame portion that is substantially U-shaped, each having a longitudinal bottom segment (e.g., 38*a*) and spaced apart upwardly extending upright segments (e.g., 38*b* and 38*c*). Each frame components 30*c* and 30*d*, alone or together with upper portions of the upright segments of the frame components 30*a* and 30*b*, make up top frame portions that interconnect the two side wall frame portions, with the top frame portions spaced apart to enable access to the container interior 34 through the opening 32. Here, the upper ends of the upright segments of each side wall frame component 30*a* and 30*b* include laterally facing slots (e.g., 40) into which tabs (e.g., 42) of the top frame components 30*c* and 30*d* engage to provide the interconnection. These tab and slot connections may incorporate locking tabs or other structure and/or may include a friction fit and/or may be held together by adhesive, heat staking and or welding.

As to the interior frame portion 36, each of the components 36*a*-36*d* is substantially L-shaped in side elevation view, to follow the contour of the exterior frame. Each of the interior frame components 36*a*-36*d* also includes an upper segment (e.g., segments 44*a*, 44*b* and 44*c* for components 36*a*, 36*d* and 36*c* respectively) that extend in alignment with the top frame components (e.g., 30*d*) so that an interconnection between the top frame components and the interior frame components can be made. Here, the upper segments 44*a*, 44*b* include openings (e.g., 46*a*, 46*b* and 46*c*) through which a fastener can be passed for the interconnection. For example, one way push clips (e.g., 48*c*) with flexing retaining arms and tabs may be used, where the push clips are integral with the top frame components. Interior frame components 36*a* and 36*b* make up one interior frame side section, which tracks the shape of exterior frame component 30*a*, and interior frame components 36*c* and 36*d* make up a second interior frame side section, which tracks the shape of exterior frame component 30*b*.

The rigid bottom 28 includes a bottom wall 50 and upwardly extending side wall segments 52*a*-52*d*. The bottom portion of the fabric of each side wall 20, 22, 24, 26 is attached to a top portion of one of the side wall segments of the rigid bottom. By way of example, the fabric may be attached to the side wall segments of the rigid bottom by stitch seam (e.g., represented by dashed line 54), with stitching that passes through the rigid plastic of both the fabric and the side wall segments. However, other attachment systems could also be used, such as adhesives, heat bonding etc. Here, the lower end of the fabric is located on the outer side of the side wall segments of the rigid bottom, but other variations are possible.

As mentioned above, the exterior frame 30 is connected to the interior frame portion 36, with such attachment being through the side walls 20 and 22, and along the top wall. More specifically, interior frame components 36*a* and 36*b* are connected to exterior frame component 30*a* through the side wall by a plurality of fasteners passing through the side wall 20, and the interior frame components 36*c* and 36*d* are attached to the exterior frame component 30*b* by a plurality of fasteners passing through the side wall. Each plurality of fasteners includes multiple fasteners (e.g., rivets, screws or pins at locations 60*a*) that pass through the aligned side wall segment (e.g., 30*a*) of the rigid bottom 30 as well as the lower portion of the fabric in the same area. Each plurality of fasteners also includes multiple fasteners (e.g., rivets, screws or pins at locations 60*b*) that pass only through the fabric (not any part of the rigid bottom) of the respective side wall. One-way push clip connections may also be used, as represented by clip 62.

Each interior frame component 36*a*-36*d* includes a lateral segment 66*a*-66*d* that extends along an upper edge of adjacent side wall segment of the rigid bottom. Each side wall segment defines shoulder (e.g., shoulder 68*c* in FIGS. 7 and 10) that sits atop the upper edge of the adjacent side wall segment to transfer forces down into the rigid bottom.

Each top frame portion includes at least one stacking or mating feature, such as the upwardly projecting features 70*c* and 70*d*. The rigid bottom 30 includes complementary stacking or mating features, such as the upwardly extending recesses or pockets 72, that mesh with the stacking or mating features 70*c* and 70*d* to enable stacking of the storage container 14 atop another storage container of the same configuration and size. In addition, side-located projections 74*c* and 74*d* are also provided and are configured to wrap slightly upward and around the sides of the rigid bottom of a container that is stacked atop the container 14. The projections 70*c* and 70*d* may include an elastomeric surface covering (e.g., 76*d*) to enhance retention of the projections 70*c* and 70*d* within the recesses of another container by resisting sliding. The elastomeric surface covering may, by way of example, be adhesively applied or overmolded.

With exception of slight variations in size and shape, the overall assembly configuration of containers 12 and 16 may be similar to that of container 14 (e.g., each container 12 and 16 including an exterior frame connected to an interior frame through fabric side walls, and a rigid bottom). Likewise, the container 18 may include a rigid bottom 18*a*, fabric side walls (e.g., 18*b*) and an exterior frame 18*c* (which may be connected to an internal frame portion). The back side 18*d* of the container 18 may be fabric or may be of a rigid plastic.

Figure 13:
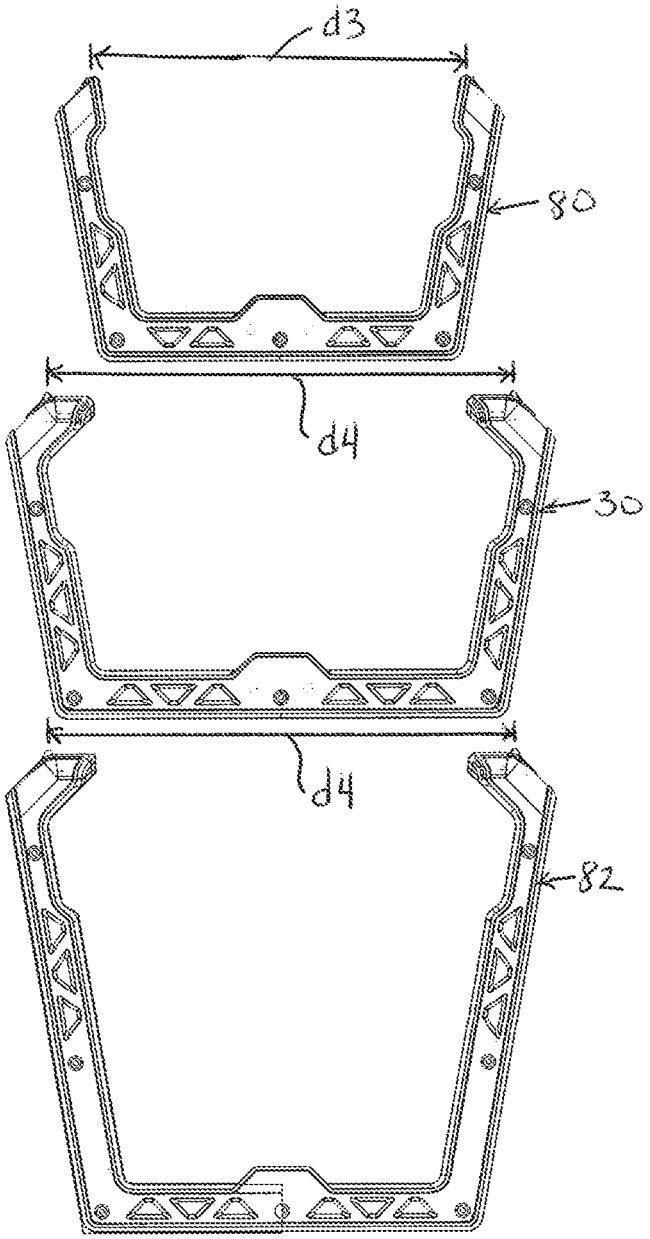
FIG. 13 is a front elevation view of the exterior frames of the stacked containers of the system.
Figure 14:
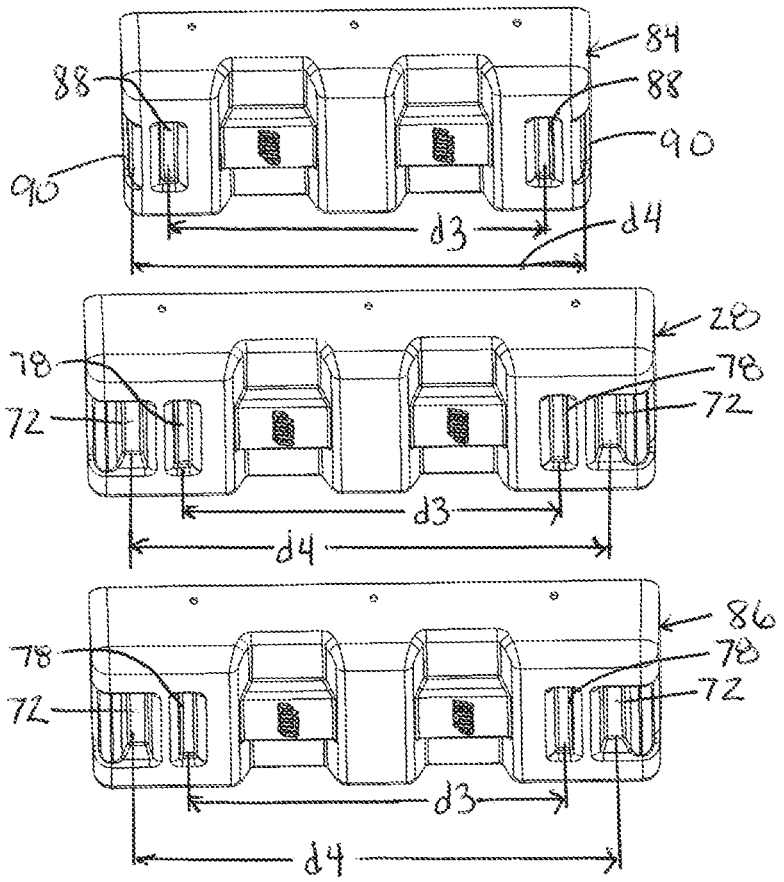
FIG. 14 is a bottom perspective view of the rigid bottoms of the stacked containers of the system.

As mentioned above, variable stackability amongst the containers is achievable. In this regard, reference is made to FIG. 13 showing the exterior frame 30 of container 14, the exterior frame 80 of container 12 and the exterior frame 82 of container 16, and FIG. 14 showing the rigid bottom 28 of container 14, the rigid bottom 84 of container 12 and the rigid bottom 86 of container 16. For reference, the rigid bottom 86 may be substantially the same as the rigid bottom 28.

Notably, the upwardly projecting stacking features of the frame 80 are spaced apart by a lateral distance d3 and the upwardly projecting stacking features of the frame 30 and the frame 82 are spaced apart by a lateral distance d4, where distance d4 is larger than distance d3 due to the relative size difference between containers. The lateral spacing between the stacking recesses 72 of the rigid bottoms 28 and 86 is distance d4, which enables the container 14 to stack atop the container 16 and enables the container 16 to stack atop container 14. Likewise, each container 14 and 16 can stack atop another identical container 14 or 16. The rigid bottoms 28 and 86 also include another set of stacking recesses 78 that are laterally spaced apart by distance d1, which enables either container 14 or container 16 to stack atop container 12. The rigid bottom 84 of container 12 includes an inner set of stacking recesses 88 spaced apart by distance d13, which enables the container 12 to stack upon another identical container 12. The rigid bottom 84 of container 12 also includes outer recesses 90 (here side recesses) that are laterally spaced apart by distance d4, which enables the container 12 to stack atop either container 14 or container 16. Thus, a versatile container system with variable stackability is provided.

Figure 15A:
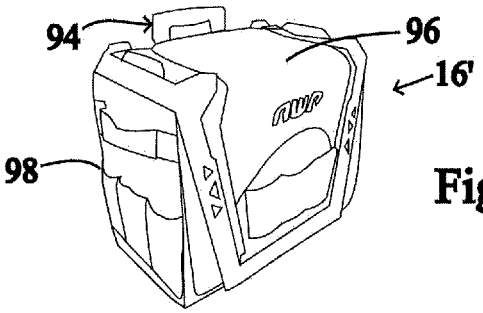
FIGS. 15A-15C depict various features that could be incorporated into the bottom container of the storage system.
Figure 15B:
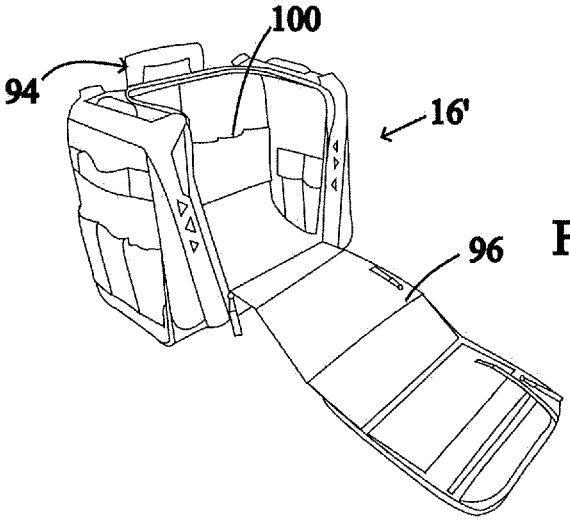
Figure 15C:
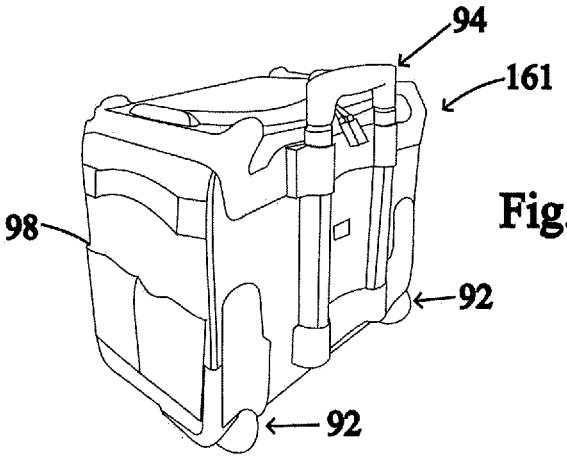

Variations in the stackable container system are possible. For example, FIGS. 15A-15C depict an embodiment of the bottom container, here 16', in which the base of the container includes an integrated set of roller wheel 92 and a telescoping pull handle 94. A closeable (e.g., by zipper) cover 96 for the top opening is also shown, where here the cover also provide access to a side opening. A variety of different shaped and sized exterior storage pockets 98 and interior storage pockets 100 may also be provided, along with internal zipper storage pocket in the cover 96.

Figure 16:
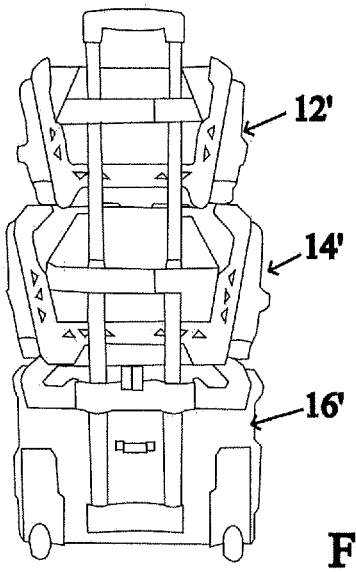
FIGS. 16 and 17 show perspective views of stacked containers.
Figure 17:
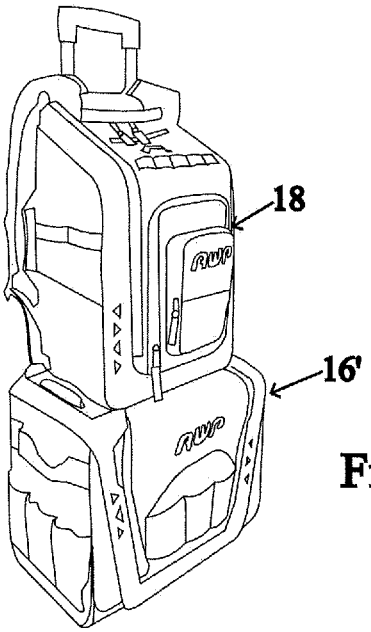
Figure 18A:
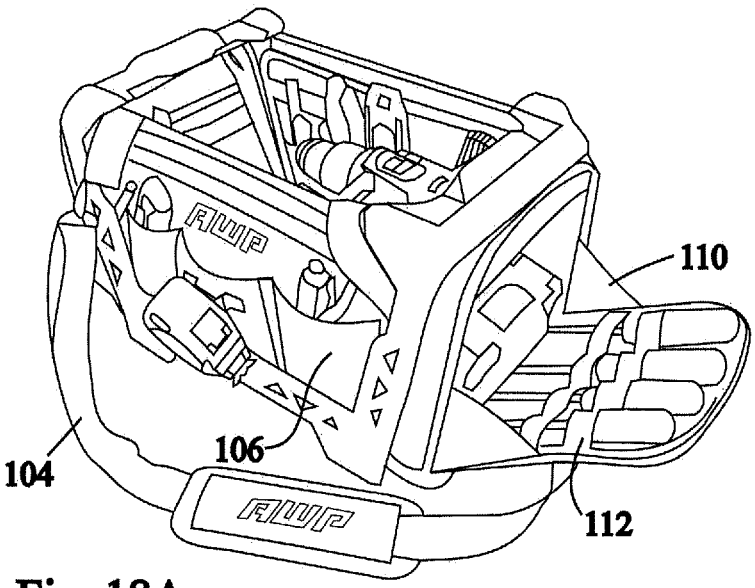
FIGS. 18A and 18B depict various features that could be incorporated into ant of the containers of the storage system.
Figure 18B:
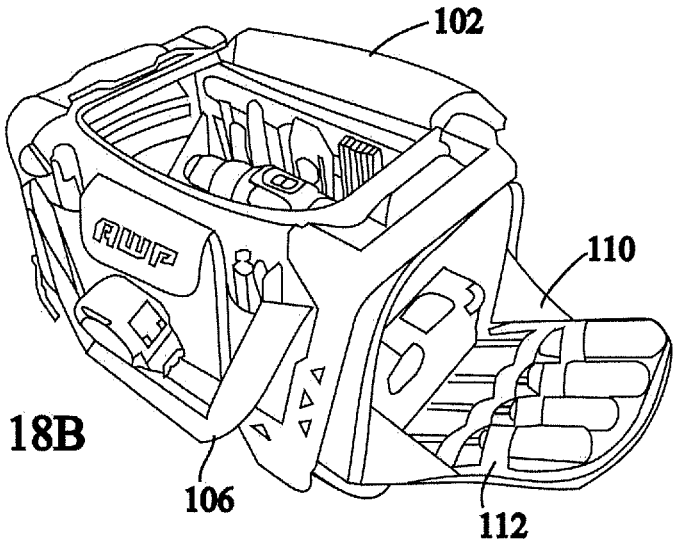
Figures 19A, 19B, 19C, 19D, 19E:
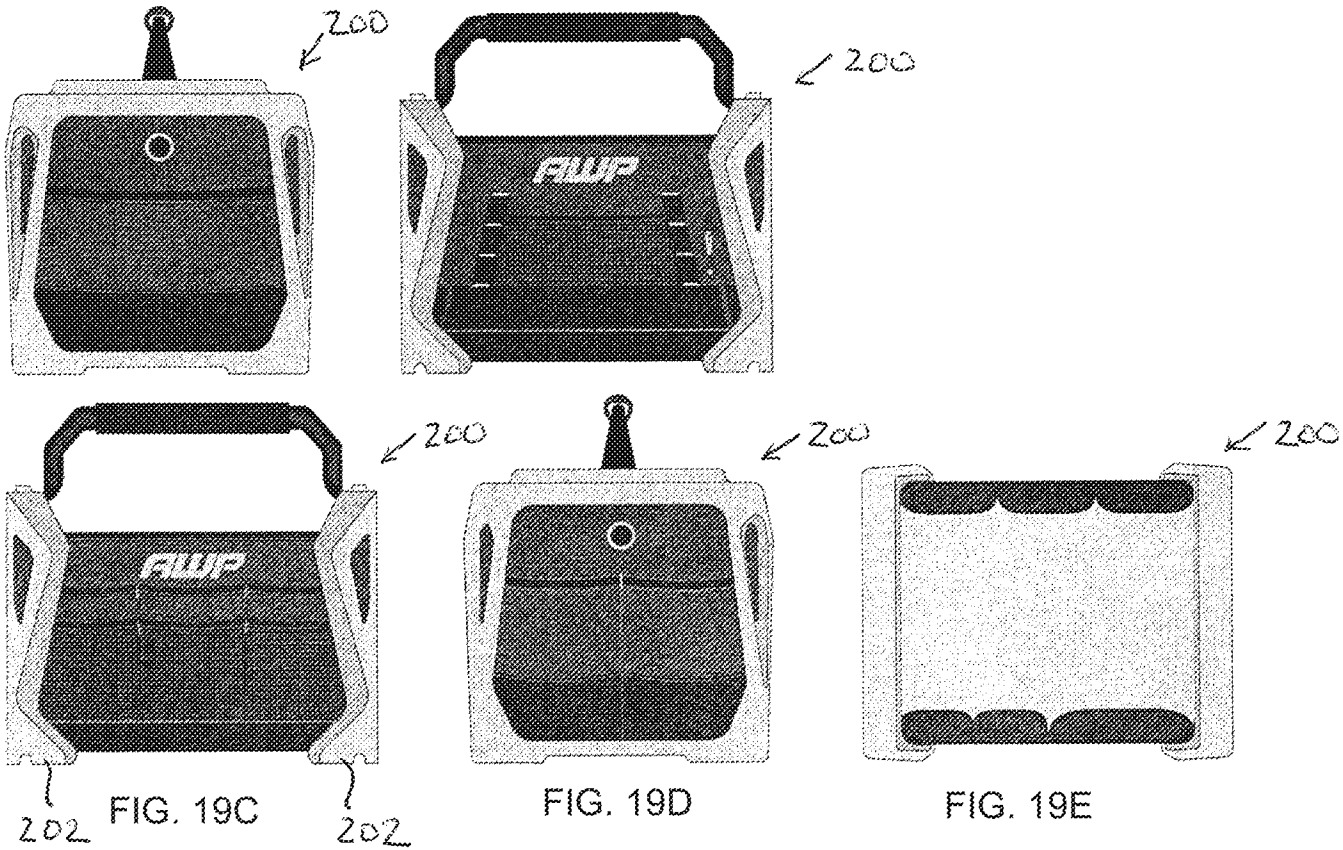
FIGS. 19A-19E show an alternative container configuration.
Figures 20A, 20B, 20C, 20D, 20E:
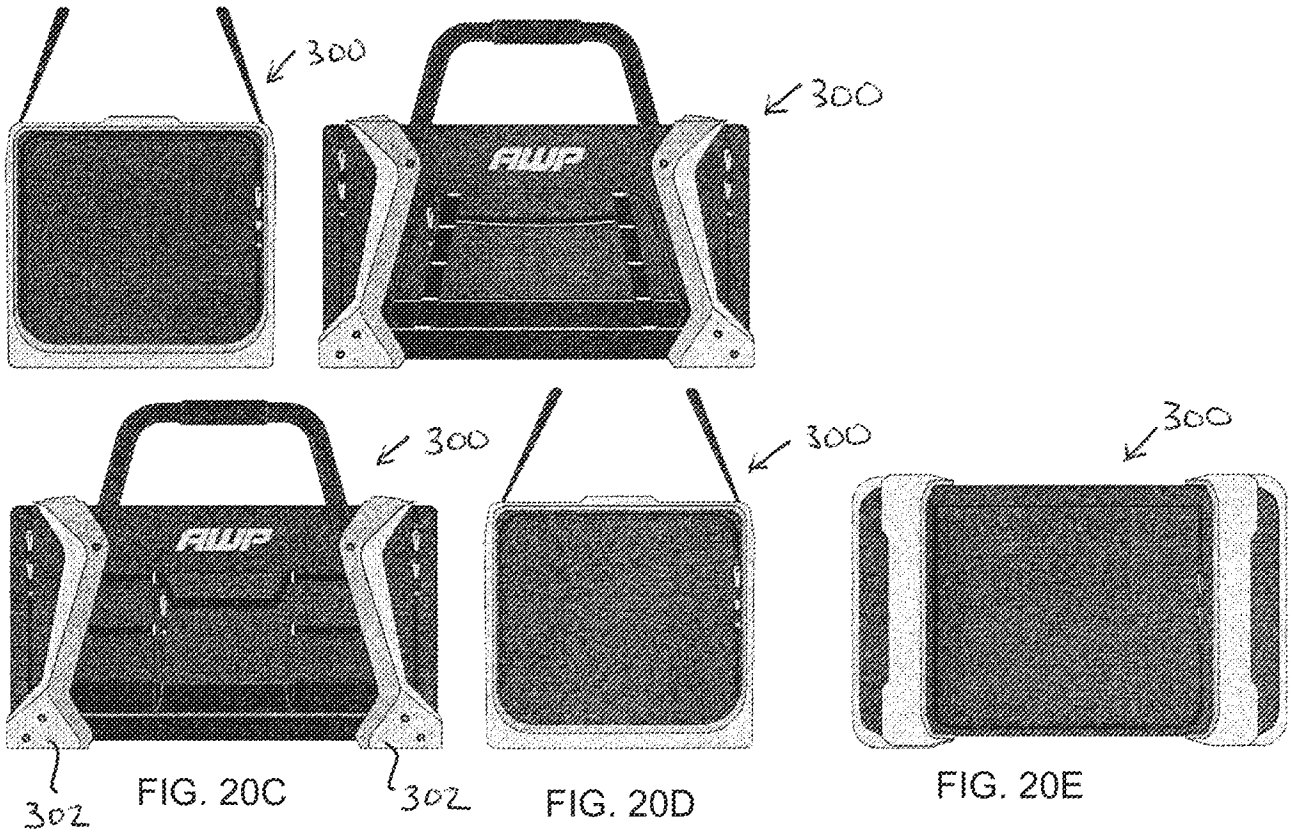
FIGS. 20A-20E show an alternative container configuration.
Figure 21:
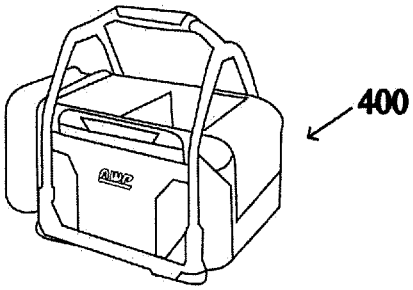
FIGS. 21-24 show alternative container configurations.
Figure 22:
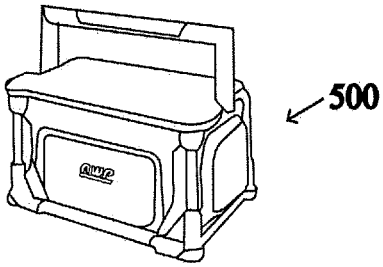
Figure 23:
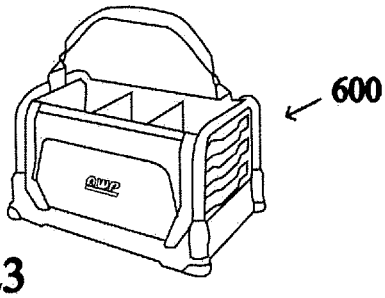
Figure 24:
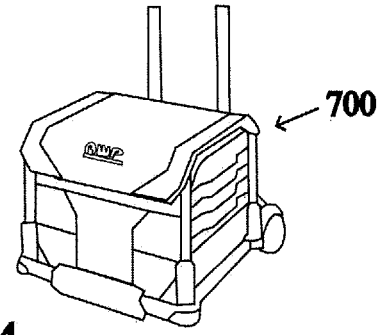

As seen in FIG. 16, the containers 12' and 14' may include straps for engaging with the telescoping handle 94 of the bottom container, to further facilitate container retention during stacked transport. Per FIG. 17, the backpack style container 18' may also be stackable. FIGS. 18A and 18B show various different features that could be incorporated into any of the containers 12, 14 and 16, such as closure cover 102, shoulder carrying strap 104, handle carrying strap 106, mesh pockets 108, zippered pocket 110 with tool retaining bands and various internal clips and pockets.

Regardless of the exact features include, the fabric sides of the containers reduce the weight of the container while providing flexibility in the shape of the container. The fabric sides also permit a variety of organization options with pockets and internal and external attachment points. The rigid plastic frame (exoskeleton) provides strength and durability for the container. The rigid plastic frame is designed so that a minimal amount of frame material is used to provide sufficient strength and durability, while minimizing the weight of the container. In one example aspect, the frame includes cut-away sections to assist with minimizing weight.

Many different variations of container systems with exoskeleton frames are possible.

FIGS. 19A-19E and 20A-20E show respective containers 200 and 300 each having primarily strong fabric forming the sides (and optionally the top) of the container. The frames may be of a rigid plastic component 202, 302 on one end of the container and a similar rigid plastic component 202, 302 on the opposite end of the container. The frame components on each end of the container are attached to the exterior surfaces of the panels of the container using any of the attachment methods previously described herein. The frames of containers 200 and 300 differ from the frames of the above embodiment in that each frame component wraps around the bottom of the container to protect the bottom surface and to support the container directly. The frame also includes features on the top and bottom portions of the frame components to facilitate stacking of the containers. In the examples shown in the images, the top portions of the frame components include protrusions and the bottom portions of the frame components include complementary recesses for receiving the protrusions. In alternate embodiments, the positions of the protrusions and the recesses on the top and bottom portions can be reversed.

FIGS. 21-24 show embodiments of containers 400, 500, 600 and 700, that have a strong fabric material forming the side walls and bottom surface of the containers. The frames, in each case, comprises tubular shaped components that form a shape along the bottom of the container and along the side surfaces of the containers. The frame components can be made from rigid plastic, metal, or any other rigid material. A variety of different types of handles can be attached to the frame.

The above disclosure is directed to soft-sided storage containers with an exoskeleton frame. The example containers described and illustrated herein combine the benefits of the prior art containers described above while also eliminating many of the disadvantages described above. It should be understood that the example containers described herein can be implemented in a variety of storage devices and are not limited to the examples provided herein. Those working in this field should understand that various modifications can be applied to the examples described herein without departing from the scope of this disclosure.

The components described herein can be made of one or more of a number of suitable materials to allow the component or other associated components to meet certain standards.

In general, components described herein can be made from multiple pieces that can be mechanically coupled to each other using one or more of a number of coupling methods, including but not limited to adhesives, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Any component described in one or more figures herein can apply to any other figures having the same label. In other words, the description for any component of a figure can be considered substantially the same as the corresponding component described with respect to another figure unless otherwise noted. For any figure shown and described herein, one or more of the components may be omitted, added, repeated, and/or substituted. Accordingly, embodiments shown in a particular figure should not be considered limited to the specific arrangements of components shown in such figure.

Although example embodiments are provided herein, it should be appreciated by those skilled in the art that various modifications are well within the scope of the disclosure. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art.

Accordingly, it is to be clearly understood that the above description is intended by way of illustration and example only, is not intended to be taken by way of limitation, and that other changes and modifications are possible.

What is claimed is:

1. A storage container comprising:

a bottom, a first side wall, a second side wall, a third side wall, a fourth side wall and a top, wherein the first, second, third and fourth side walls each comprise fabric, wherein the bottom comprises a rigid bottom, wherein the top defines an opening to an interior of the storage container;

a rigid exterior frame, the rigid exterior frame comprising a first side wall frame portion connected to the first side wall and running adjacent to and in direct contact with an exterior surface of the first side wall, a second side wall frame portion connected to the second side wall and running adjacent to and in direct contact with an exterior surface of the second side wall, a first top frame portion, and a second top frame portion, the first top frame portion running above and over the top such that the first top frame portion overlies part of the top in a top plan view, the first top frame portion interconnecting the first side wall frame portion and the second side wall frame portion, the second top frame portion running above and over the top such that the second top frame portion overlies part of the top in the top plan view, the second top frame portion interconnecting the first side wall frame portion and the second side wall frame portion, wherein the first top frame portion and the second top frame portion are spaced apart to enable access to the interior through the opening;

a rigid interior frame including a first interior frame side section attached to the first side wall frame portion through the first side wall, and a second interior frame side section attached to the second side wall frame portion through the second side wall;

wherein the first interior frame side section includes a first lateral segment that extends along an upper edge of the first side wall segment of the rigid bottom, the first lateral segment defining a first lip that sits atop the upper edge of the first side wall segment to transfer forces down into the rigid bottom;

wherein the second interior frame side section includes a second lateral segment that extends along an upper edge of the second side wall segment of the rigid bottom, the second lateral segment defining a second lip that sits atop the upper edge of the second side wall segment to transfer forces down into the rigid bottom.

2. The storage container of claim 1, wherein the first top frame portion includes at least one mating feature and the second top frame portion includes at least one mating feature;

wherein the rigid bottom includes at least two complementary mating features that mesh with the mating features on the first top frame portion and the second top frame portion to enable stacking of the storage container.

3. The storage container of claim 2, wherein the mating feature of the first top frame portion is an upwardly projecting feature, the mating feature of the second top frame portion is an upwardly projecting feature, and the complementary mating features of the rigid bottom are upwardly extending recesses of a bottom surface of the rigid bottom.

4. The storage container of claim 3, wherein the upwardly projecting feature of the first top frame portion includes an elastomeric surface covering and the upwardly projecting feature of the second top frame portion includes an elastomeric surface covering.

5. The storage container of claim 1, wherein the rigid bottom includes a bottom wall with upwardly extending first, second, third and fourth side wall segments, wherein:

a bottom portion of the fabric of the first side wall is attached to a top portion of the first side wall segment;

a bottom portion of the fabric of the second side wall is attached to a top portion of the second side wall segment;

a bottom portion of the fabric of the third side wall is attached to a top portion of the third side wall segment; and a bottom portion of the fabric of the fourth side wall is attached to a top portion of the fourth side wall segment.

6. The storage container of claim 5, wherein, for each of the first, second, third and fourth side walls, the fabric is attached to the respective first, second, third or fourth side wall segment by stitching.

7. The storage container of claim 1, wherein the first interior frame side section is attached to the first side wall frame portion by a first plurality of fasteners passing through the first side wall, and the second interior frame side section is attached to the second side wall frame portion by a second plurality of fasteners passing through the second side wall.

8. The storage container of claim 7, wherein the first plurality of fasteners includes multiple fasteners that pass through the first side wall segment of the rigid bottom and multiple fasteners that pass through the fabric of the first side wall, and the second plurality of fasteners includes multiple fasteners that pass through the second side wall segment of the rigid bottom and multiple fasteners that pass through the fabric of the second side wall.

9. The storage container of claim 1, wherein the first interior frame side section is comprised of two separate pieces and the second interior frame side section is comprised of two separate pieces.

10. The storage container of claim 1, wherein first side wall frame portion is substantially U-shaped with a first lower lateral segment and spaced apart upwardly extending first and second upright segments;

wherein second side wall frame portion is substantially U-shaped with a second lower lateral segment and spaced apart upwardly extending third and fourth upright segments.

11. The storage container of claim 10, wherein each of the first lower lateral segment, the first upright segment and the second upright segment includes a plurality of through openings for weight reduction;

wherein each of the second lower lateral segment, the third upright segment and the fourth upright segment includes a plurality of through openings for weight reduction.

12. The storage container of claim 1, wherein at least one of the first, second, third and fourth sidewalls includes an exterior storage pocket formed thereon;

wherein at least one of the first, second, third and fourth sidewalls includes an interior storage pocket formed thereon.

13. The storage container of claim 1, wherein the opening in the top is closeable by a zippered fabric cover.

14. A storage container comprising:

a bottom, a first side wall, a second side wall, a third side wall, a fourth side wall and a top, wherein the first, second, third and fourth side walls each comprise fabric, wherein the bottom comprises a rigid bottom, wherein the top defines an opening to an interior of the storage container;

a rigid exterior frame, the rigid exterior frame comprising a first side wall frame portion connected to the first side wall and running adjacent to and in contact with an exterior surface of the first side wall, a second side wall frame portion connected to the second side wall and running adjacent to and in contact with an exterior surface of the second side wall, a first top frame portion, and a second top frame portion, the first top frame portion running above and over the top and interconnecting the first side wall frame portion and the second side wall frame portion, the second top frame portion running above and over the top and interconnecting the first side wall frame portion and the second side wall frame portion, wherein the first top frame ortion and the second top frame portion are spaced apart to enable access to the interior through the opening;

a rigid interior frame including a first interior frame side section attached to the first side wall frame portion through the first side wall, and a second interior frame side section attached to the second side wall frame portion through the second side wall;

wherein the first interior frame side section includes a first upper segment and a second upper segment, wherein the first upper segment is connected to the first top frame portion and the second upper segment is connected to the second top frame portion;

wherein the second interior frame side section includes a third upper segment and a fourth upper segment, wherein the third upper segment is connected to the first top frame portion and the fourth upper segment is connected to the second top frame portion.

15. The storage container of claim 14, wherein the first interior frame side section is formed separately from the second interior side frame section.

16. A storage container comprising:

a bottom, a first side wall, a second side wall, a third side wall, a fourth side wall and a top, wherein the first, second, third and fourth side walls each comprise fabric, wherein the bottom comprises a rigid bottom, wherein the top defines an opening to an interior of the storage container;

a rigid frame that provides support for the storage container, the rigid frame including an exterior frame portion located externally of the interior and an interior frame portion located within the interior, wherein the exterior frame portion comprises a side wall frame portion and a top frame portion, at least part of the side wall frame portion extending upward along the first side wall, the top frame portion extending from the side wall frame portion and along the top;

wherein the interior frame portion comprises a side section with a side segment extending upward along the first side wall and an upper segment extending along the top;

wherein the side section of the interior frame portion is connected to the side wall frame portion of the exterior frame portion through the first side wall, and the upper segment of the interior frame portion is connected to the top frame portion of the exterior frame portion through the top.

17. The storage container of claim 16, wherein the rigid bottom includes a bottom wall with upwardly extending first, second, third and fourth side wall segments;

wherein multiple fasteners pass through at least one of the first, second, third or fourth side wall segments of the rigid bottom.

* * * * *